United States Patent [19]

Reuter et al.

[11] 4,425,960

[45] Jan. 17, 1984

[54] METHOD OF AND AN APPARATUS FOR THE MANIPULATION OF A STARTING CHAIN FOR FORMAT CHANGES IN A CONTINUOUS CASTING INSTALLATION

[75] Inventors: Hans J. Reuter, Kürten-Biesfeld; Hermann Take, Cologne, both of Fed. Rep. of Germany; Charles Werner, Esch, Luxembourg

[73] Assignee: Mecan ARBED s.a r.l., Luxembourg, Luxembourg

[21] Appl. No.: 260,931

[22] Filed: May 6, 1981

[51] Int. Cl.[3] ..... B22D 11/08

[52] U.S. Cl. ..... 164/426; 164/446; 164/483

[58] Field of Search ..... 164/425, 426, 445, 446, 164/483

[56] References Cited

U.S. PATENT DOCUMENTS

| | | | |
|---|---|---|---|
| 3,773,103 | 11/1973 | Burkhardt | 164/426 |
| 3,930,533 | 1/1976 | Rokop | 164/426 |
| 4,291,748 | 9/1981 | Langner | 164/426 |

FOREIGN PATENT DOCUMENTS

| | | |
|---|---|---|
| 1458211 | 4/1970 | Fed. Rep. of Germany . |
| 1499224 | 9/1967 | France . |
| 2070759 | 9/1971 | France . |
| 2006066 | 5/1979 | United Kingdom . |

*Primary Examiner*—Gus T. Hampilos
*Assistant Examiner*—Richard K. Seidel
*Attorney, Agent, or Firm*—Karl F. Ross; Herbert Dubno

[57] ABSTRACT

A system for the rapid insertion and removal of a starting chain for the change of format or cross section of a continuous strand casting operation utilizing such starting chains, comprises an arcuate guide into which a portion of the chain can be drawn, a swingable ramp for lifting this portion of the chain into alignment with another arcuate guide at a device for separating the chain into segments or joining a segment of the chain to another portion thereof, and an automatic gripper, lifter and transport system for the chain segments. The latter mechanism is provided at the free end of the second arcuate guide.

5 Claims, 2 Drawing Figures

METHOD OF AND AN APPARATUS FOR THE MANIPULATION OF A STARTING CHAIN FOR FORMAT CHANGES IN A CONTINUOUS CASTING INSTALLATION

FIELD OF THE INVENTION

Our present invention relates to an apparatus for the manipulation of a starting chain and segments thereof for format changes in continuous strand casting installations and, more particularly, to a system for the rapid introduction and withdrawal of a starting chain upon a change in the format or cross section of a continuously cast strand in a continuous casting installation.

BACKGROUND OF THE INVENTION

In the continuous casting of metals, such as steel, the melt is fed substantially continuously into a continuous casting mold and travels as a continuously cast strand along a guide over which the strand is cooled. The continuously cast strand may then be subdivided into sections of predetermined length and subjected to rolling or drawing with or without intervening cooling, soaking or other reheating processes.

At the start of each casting operation, it is known to use so-called starting chains which must be manipulated, i.e. fed into position and withdrawn from position, during each format change or change in the cross section of the strand to be produced.

The manipulation of starting chains during format changes in continuous casting installations is a time-consuming and complex problem requiring, heretofore, space-consuming apparatus which must be coordinated with a high degree of manual labor and hence requires a significant amount of time.

During this period, the continuous casting installation is at a stand-still so that the productivity of the installation is directly affected in an adverse manner by the time required for the handling of the starting chains.

Conventional systems also have been found to create problems in starting chain manipulation such as increasing the downtime and interrupting the continuity of operations of the continuous casting plant as well.

It is apparent that it is desirable to provide a multiplicity of starting chains which can be provided with heads whose configurations vary in accordance with the different formats to be generated. These chains can be stored in magazines so as to be held ready for use and the magazines or transfer carriages can be provided to enable the individual chain segments with their respective heads to be manipulated at the inception of each casting operation.

Magazines for starting chains generally have, because of the frequently considerable length of the chains, significant volume, and the removal of a chain from the magazine and the introduction into the magazine after use can require not only considerable work but complex ancillary equipment which also occupies considerable space.

OBJECTS OF THE INVENTION

It is thus the principal object of the present invention to provide an apparatus for the manipulation of starting chains so that the introduction and removal of the starting chain can be carried out rapidly, thereby minimizing interruptions in the casting sequence.

Another object of our invention is to provide an apparatus for the manipulation of starting chains which enable the chains to be handled in a relatively small space and with a minimum of manual labor over a much shorter period of time than has heretofore been the case, thereby allowing the intervals between casting operations to be minimized.

SUMMARY OF THE INVENTION

These objects and others which will become apparent hereinafter are attained, in accordance with the present invention, in a system which provides for the coupling of the individual chain segments to, and the decoupling of chain segments from, a remainder of the starting chain by introducing this remainder into a preferably arcuate guide in which this remainder can be immobilized and, for coupling or decoupling, a portion of the chain is brought into another arcuate guide (lying in a common vertical plane with the first guide) which can be aligned with the first at one end and which is provided at its opposite end with a gripper, lifting and transport mechanism which enable the chain segments to be disconnected from or connected to the aforementioned remainder of the starting chain.

As will be apparent from the foregoing, only individual starting chain sections need be stored while, practically continuously, the remainder of the chain remains available to receive or provide a starting chain segment.

BRIEF DESCRIPTION OF THE DRAWING

The above and other objects, features and advantages of the present invention will become more readily apparent from the following description, references being made to the accompanying drawing in which.

SPECIFIC DESCRIPTION

Figure 1:
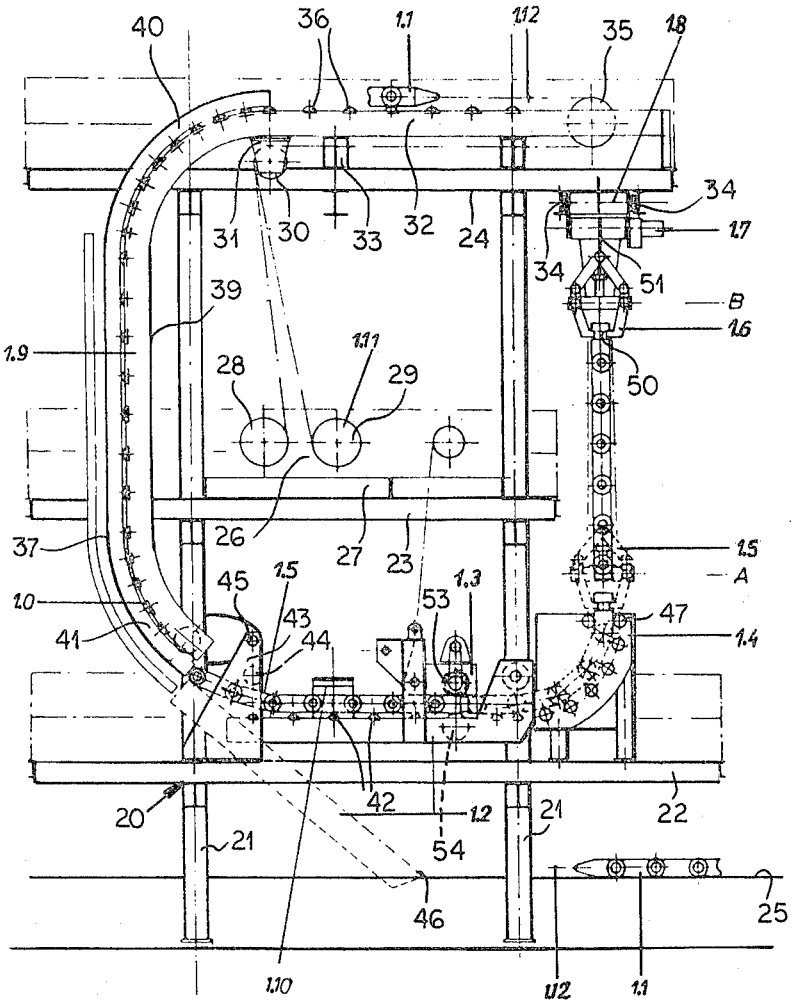
FIG. 1 is a diagrammatic elevational view, partly in section, illustrating the arcuate guides and the gripper-lifter-transport mechanism of the invention.

In FIG. 1 of the drawing, we show a support 20 comprising uprights 21 and horizontal beams 22, 23 and 24 mounted on these uprights above a table 25 forming a transport path for a length 1.1 of starting chain 1.0 which will hereinafter be referred to as the remainder of this chain because segments 1.5 can be removed or added thereto in the manner to be described below.

The support 20 carries a motor and speed-reducing gearing, represented at 26 on a platform 27 to operate the drum 28 and 29 of a windlass 1.11, the cables 1.12 of which pass over an idler wheel 30 journaled on a bracket 31 depending from a horizontal guide portion 32 mounted on horizontal beams 33 extending across the beams 24 which also serve to support rails 34 on which roll the wheels of a carriage 1.8, the function of which will be described below.

The cables 1.12 also pass over a pulley 35 journaled on the guide member 32 to run along the top of the latter.

The guide member 32 is provided with rollers 36 along which the remainder 1.1 of the chain can be supported.

The apparatus of FIG. 1 is used, as previously described, to connect or couple an individual starting chain segment 1.5 to the remainder 1.1 of the chain or to disconnect or decouple a starting chain segment of any desired length from this chain remainder 1.1.

According to the invention, chain remainder 1.1 is introduced into an arcuate guide 1.9 and brought to rest therein. The arcuate guide 1.9 is formed with a stationary wall 37 against which the chain remainder 1.1 may be held by an array of rollers 36, the guide 1.9 having a vertical section 39 and an upper elbow 40 which opens onto the guide 32. A lower elbow 41 communicates with a swingable ramp 1.2 which is formed with guide rollers 42 and is affixed to brackets 43, only one of which has been shown. The brackets 43 carry the guide rollers 44 and are pivoted to the support 20 at 45 so that ramp 1.2 can swing between the dot-dash and solid line positions shown, i.e. between a position in which the lower end 46 of the ramp 1.2 lies at the plane of the table 25 and a position in which the ramp 1.2 is horizontal.

The support 20 also carries a fixed coupling mechanism for the automatic separation of or joining of links of the chain.

In the horizontal position, the ramp 1.2 is aligned with another arcuate guide 1.4 having guide rollers 47 and an upwardly turned end at which a gripper-lifter-transport system 1.6, 1.7, 1.8 is effective to engage a length of chain separated from the starting chain 1.0 to thereby form the segment 1.5 and the chain remainder 1.1.

To separate the starting chain 1.0 into the starting chain segment 1.5 and the remainder 1.1, the chain is introduced into the guides 1.9 and 1.4 so that the links to be separated are disposed directly ahead of the fixed coupling mechanism 1.10. Conversely, to couple a segment 1.5 onto the remainder 1.1 the segment 1.5 is introduced into the guide 1.4 while the remainder 1.1 is introduced into guide 1.9 so that the links to be connected lie directly ahead of the fixed coupling mechanism 1.10. The link pins can be removed or inserted manually or automatically.

For introducing the starting chain 1.0 into the guide 1.9 to its rest position, the ramp 1.2 is lowered and the cable 1.12 is connected to the end of the chain 1.0 (or a remainder 1.1) on the support 25 as shown in the lower portion of FIG. 1. The windlass 1.11 is then operated to draw this end of the chain 1.0 (or 1.1) onto the guide 32 as shown in the upper portion of FIG. 1, the ramp 1.2 is swung upwardly into its solid line position and the end of the chain is then permitted to feed through the guide 1.4 or is positioned to meet a starting chain segment 1.5 which can be lowered into the guide 1.4 by the mechanism 1.6, 1.7, 1.8.

A drive 1.3 is provided for the chain segment 1.5 to be coupled to the chain remainder 1.1 or to be decoupled from the chain 1.0.

Figure 2:
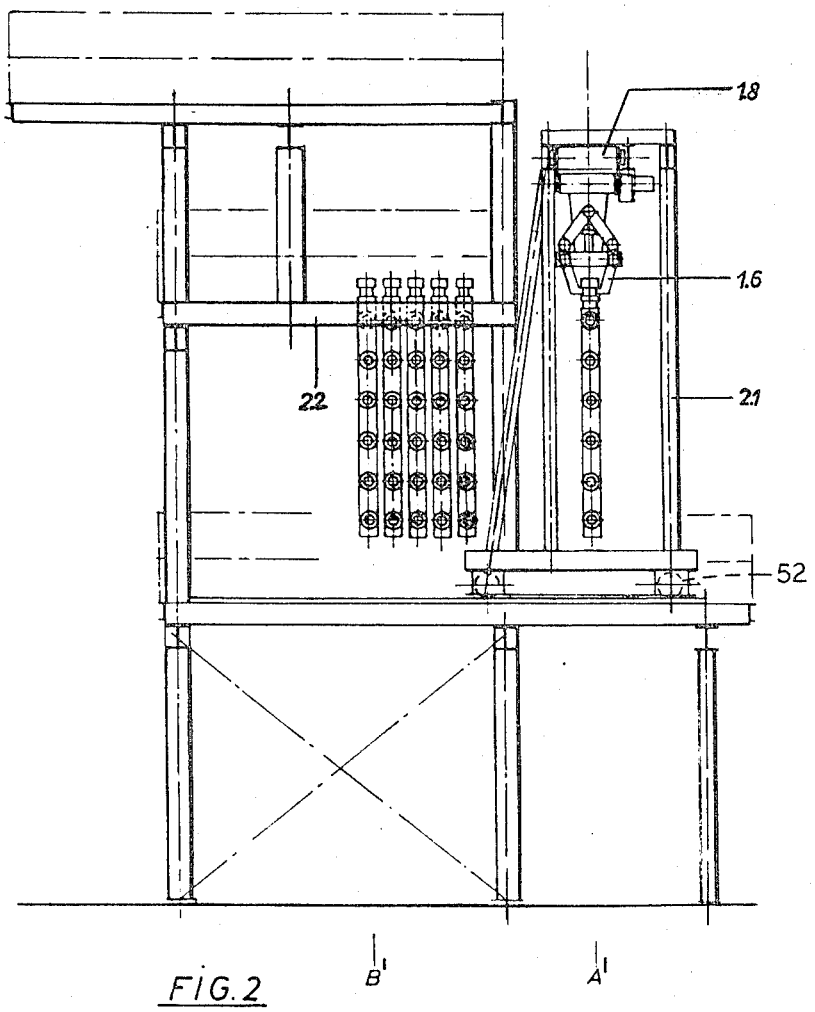
FIG. 2 is a similar view showing the magazine and the chain-changing carriage which carries the chain to and from the magazine and bears the above-mentioned mechanism.

The gripper-lifter-transport mechanism comprises a pair of tongs 1.6 adapted to engage the head 50 of a starting chain segment and raised and lowered by a cable 51 via a windlass 1.7 on a carriage 1.8 and hence the entire mechanism to a change carriage 2.1 (FIG. 2) displaceable via the wheels 52 into and out of the magazine 2.2. The carriage 1.8 and the carriage 2.1 can be provided with automatically operable transfer means to enable the chain segments to be deposited in or extracted from the magazine.

Thus the guide 1.9 can contain at any time a section of chain, referred to earlier as the remainder, which can be connected rapidly to a section drawn from the magazine to prepare a starting chain for use or to recover a length of chain from a previously used starting chain. The arcuate guide arrangement ensures that the entire installation will occupy a minimum of space.

The delivery of a chain segment into the guide 1.4 is effected in part by the drive rollers 53, 54 of the drive mechanism 1.3 and in part by the weight of the length of chain in the guide 1.9 when the ramp 1.2 is swung upwardly. The tongs 1.6 can be actuated hydraulically to withdraw a section from the guide 1.4 when this section is seized in the position A. The windlass 1.7 then lifts the separated segment to position B for the transverse displacement of the carriage 1.8 to deliver the chain to the change carriage 2.1. The chain carriage can be shifted at A′ (FIG. 2) to its position B′ to deposit the chain in the magazine.

When the carriage 2.1 is returned to its position A, the carriage 1.8 can be shifted into alignment with another magazine row for withdrawal of a different starting chain segment. The introduction of the starting chain segment and its attachment to the length 1.1 is effected in the reverse manner.

We claim:

1. In a continuous casting apparatus including an installation for the manipulation of starting chain segments for continuous strand casting whereby such segments for starting the continuous strand casting process whereby such starting chain segments are coupled to and decoupled from a remainder of a starting chain, the improvement which comprises:

an arcuate first upright guide having an upper end and a lower end, said arcuate first upright guide being adapted to receive said remainder of starting chain;

means associated with said arcuate first upright guide for displacing said remainder into said arcuate first upright guide and for retaining said remainder of starting chain at rest in said arcuate first upright guide;

an arcuate second guide having a lower end aligned with the lower end of said arcuate first upright guide and an upwardly opening upper end;

gripper means associated with said arcuate second guide and positionable above said upper end of said arcuate second guide for engaging a starting chain segment and lowering same into and retracting same from said arcuate second guide;

means associated with said gripper means for shifting said gripper means from a position wherein said gripper means is aligned with said upper end of said arcuate second guide into a position wherein starting chain segments can be transferred by said gripper means to or from a magazine; and means between said guides for enabling the coupling and decoupling of links of said remainder of starting chain and a segment disposed in said arcuate second guide.

2. The improvement defined in claim 1, further comprising a swingable ramp between the lower end of said arcuate first upright guide and the lower end of said arcuate second guide, said ramp being swingable between a position wherein said ramp connects said lower ends of said guides and a position wherein said ramp is inclined upwardly to said lower end of said arcuate first upright guide for enabling a length of chain to be drawn into said arcuate first upright guide.

3. The improvement defined in claim 2, further comprising a windlass having a cable connected to said gripper means for raising and lowering same, and a carriage carrying said windlass and shiftable transversely to a vertical plane containing said guides, thereby carrying said gripper means into the region of said magazine.

4. The improvement defined in claim 3 wherein said magazine is provided with a change carriage having rails adapted to receive the carriage mounting said windlass.

5. The improvement defined in claim 4 wherein said change carriage is displaceable on rails enabling said gripper means to be shiftable along rows of chains in said magazine.

* * * * *